US011582999B2

(12) United States Patent
Moroz

(10) Patent No.: US 11,582,999 B2
(45) Date of Patent: Feb. 21, 2023

(54) CIGARETTE MOUTHPIECE

(71) Applicant: Leonid Moroz, Erie, CO (US)

(72) Inventor: Leonid Moroz, Erie, CO (US)

( * ) Notice: Subject to any disclaimer, the term of this patent is extended or adjusted under 35 U.S.C. 154(b) by 0 days.

(21) Appl. No.: 17/492,344

(22) Filed: Oct. 1, 2021

(65) Prior Publication Data

US 2022/0104537 A1 Apr. 7, 2022

Related U.S. Application Data

(60) Provisional application No. 63/086,107, filed on Oct. 1, 2020.

(51) Int. Cl.

| | |
|---|---|
| ***A24D 3/18*** | (2006.01) |
| ***A24D 1/04*** | (2006.01) |
| ***A24C 5/47*** | (2006.01) |

(52) U.S. Cl.

CPC ..... *A24D 3/18* (2013.01); *A24C 5/47* (2013.01); *A24D 1/04* (2013.01); *A24D 1/042* (2013.01)

(58) Field of Classification Search

CPC ..... A24C 5/47; A24D 1/042; A24D 3/18
USPC ..... 131/330
See application file for complete search history.

(56) References Cited

U.S. PATENT DOCUMENTS

| | | | | |
|---|---|---|---|---|
| 170,752 | A * | 12/1875 | Marquis | A24D 1/042 |
| 880,488 | A | 2/1908 | Julien | |
| 976,624 | A | 11/1910 | Wolff | |
| 4,887,617 | A | 12/1989 | Ruppert | |
| 2005/0109358 | A1 | 5/2005 | Wheeler | |
| 2012/0097179 | A1* | 4/2012 | Kesselman | A24C 5/46 131/280 |

FOREIGN PATENT DOCUMENTS

| | | |
|---|---|---|
| AT | 36203 | 2/1909 |
| DE | 102006021848 | 9/2009 |

* cited by examiner

*Primary Examiner* — Michael J Felton
*Assistant Examiner* — Ronnie Kirby Jordan
(74) *Attorney, Agent, or Firm* — Leyendecker & Lemire, LLC

(57) ABSTRACT

A cigarette mouthpiece is described. Embodiments of the cigarette mouthpiece include cigarette mouthpiece made from a strip of flexible material having a varying width. A width of the strip of flexible material can help determine a length of a user engagement portion and a cigarette engagement portion of the cigarette mouthpiece. The cigarette mouthpiece can have a substantially circular cross-sectional shape and a diameter of the cigarette mouthpiece can be adjustable. Typically, an outside diameter of the cigarette engagement portion can be altered to fit into differently sized rolled cigarettes.

18 Claims, 7 Drawing Sheets

CIGARETTE MOUTHPIECE

CROSS-REFERENCE TO RELATED APPLICATION

This application claims the benefit of U.S. Provisional Application No. 63/086,107, filed Oct. 1, 2020.

BACKGROUND

Smokers who roll their own cigarettes and use a mouthpiece often have a difficult time getting the mouthpiece to stay securely attached to a cigarette. The cigarette has to be rolled just the right diameter to match with the diameter of the mouthpiece to create enough frictional force to prevent it from falling out, or the adhesive from the rolling paper has to be utilized to glue a mouthpiece to the cigarette. Both of these methods are cumbersome and inexact, taking away time and pleasure from the smoking experience.

A cigarette mouthpiece that allows the smoker to roll cigarettes without having to match the diameter of the cigarette to the diameter of the mouthpiece is needed. More specifically, a cigarette mouthpiece with an adjustable diameter configured to adjust to an internal diameter of a rolled cigarette and expand enough to lock in place is needed.

DETAILED DESCRIPTION

Figure 1B:
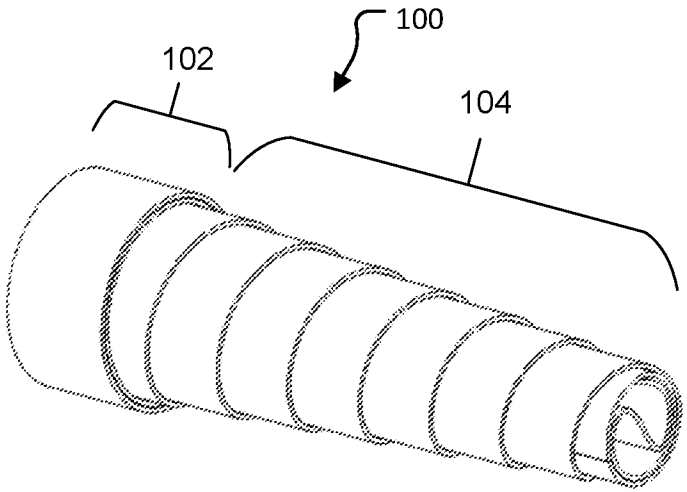
FIG. 1B is a back perspective view of a cigarette mouthpiece according to one embodiment of the present invention.

Embodiments of the present invention include a cigarette mouthpiece. The cigarette mouthpiece can typically be implemented with hand rolled cigarettes and the like. The cigarette mouthpiece can include, but is not limited to, a flexible sheet of material having a variable width that can be rolled into a truncated cone having a cigarette engagement portion and a user engagement portion. Of note, a first width of the flexible sheet can determine a length of the user engagement portion and a second width of the flexible strip can determine a length of the cigarette engagement portion. Typically, the first width can be greater than the second width and the flexible sheet of material can taper from the first width to the second width.

The cigarette mouthpiece can be inserted into and secured to a rolled cigarette without the use of adhesives. Of note, a diameter of the cigarette engagement portion can be adjusted smaller to allow the cigarette mouthpiece to be inserted into the rolled cigarette and then the diameter of the cigarette engagement portion can be adjusted bigger to engage an interior of the rolled cigarette. Currently, smokers have to roll their cigarettes to match to a diameter of currently available mouthpieces they are using. As previously mentioned, a diameter of the disclosed cigarette mouthpiece can be adjusted (e.g., expanded or contracted) to fit the rolled cigarette. By having a mouthpiece with an adjustable diameter, a smoker can roll the cigarette first and then insert the cigarette mouthpiece allowing for more of the cigarette paper to be used for holding the tobacco (or herb) instead of a filter. Further, the cigarette mouthpiece can be loosened (i.e., diameter decreased) to be moved away from tobacco in the rolled cigarette and then can be reengaged (i.e., diameter increased) to lock the cigarette mouthpiece in place allowing all of the tobacco to be smoked without risking the cigarette mouthpiece from igniting.

In one embodiment, the cigarette mouthpiece can include a single sheet of flexible material that can be rolled in a cylindrical fashion. In one example, ordinary printing paper can be implemented as the flexible material. It is to be appreciated that a variety of different flexible materials can be implemented and the examples given are not meant to be limiting. Typically, the flexible material can be paper. The sheet of paper can be cut into a strip of paper having a varying width. The strip of paper can be rolled starting at a wider end by creating two loops that fold over themselves to create a substantially "S-curve." The strip of paper can then be rolled while maintaining the substantially S-curve in the center. The strip of paper can then be rolled entirely resulting in a geometry closely resembling a very steep truncated cone. A loose end of the rolled paper may be adhered (e.g., glued or taped) or physically secured in place (e.g., via a strap) to prevent a tip of the rolled paper from unrolling until the cigarette mouthpiece is ready to be used.

In a typical implementation, the cigarette mouthpiece can be provided with a pair of rods. To use the cigarette mouthpiece, the secured end of the cigarette engagement portion can be unsecured. Then, the cigarette engagement portion can be sized to be inserted into a hollow (i.e., tobacco free) portion of a rolled cigarette. After the cigarette engagement portion is inserted into the rolled cigarette, the cigarette engagement portion can expand radially until being stopped by an inner wall of the rolled cigarette. Finally, a user can grip the inserted end of the cigarette mouthpiece over the cigarette paper while the user engagement portion can be twisted in a direction of the spiral towards the inserted end causing the inserted end to expand and apply a pressure to the interior surface of the rolled cigarette, thereby securing the cigarette engagement portion in place.

In one instance, the cigarette mouthpiece can be formed from an elongated strip of material cut from a larger sheet of the material. The elongated strip may vary in size and shape. Generally, a first section may have a first width that tapers down to a second section having a second width. The tapered section may run all the way from a first end to a second end of the strip. The tapered section may have a straight, curved concave, or curved convex taper. A top of the elongated strip may be wavy, jagged, irregular, and/or straight. In one instance, the strip of material may be embedded with and/or entirely composed of a material that filters smoke. In another instance, the strip of material may be embedded with a material that enhances a flavor of smoke from the rolled cigarette.

In one embodiment, the strip of material may be rolled in a variety of different fashions. For instance, the cigarette mouthpiece can be created by using loops or folding the strip initially instead of creating the S-curve before rolling the elongated strip. In one instance, the cigarette engagement portion can be reusable if the elongated strip of material is made of materials that allow for reusability. In one example embodiment, the strip of material can be rolled with a single loop thereby creating a cigarette engagement portion of the cigarette mouthpiece with a singe central hole down a center of the cigarette mouthpiece. In such an example embodiment, a filter can be placed in the central opening resulting in a filtered cigarette mouthpiece that can be secured to an interior of a rolled cigarette via friction.

During manufacture, a loose end of the cigarette engagement portion (e.g., the second end of the elongated strip) may be glued with a low strength, smoke-safe adhesive that can be broken when under a shear stress when the user engagement portion is being untwisted to lock the cigarette mouthpiece in place. In one instance, a slightly higher strength adhesive may be applied to an outside surface of the second end allowing the cigarette engagement portion to tack onto inside walls of a rolled cigarette. Of note, by implementing the adhesive on the exterior surface, the additional gripping power can help facilitate a breaking of the interior adhesive bond that initially prevented the loose end of the cigarette engagement portion from unwrapping while twisting the user engagement portion to lock the cigarette mouthpiece in place.

Terminology

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term “couple” or “coupled” as used in this specification and appended claims refers to an indirect or direct physical connection between the identified elements, components, or objects. Often the manner of the coupling will be related specifically to the manner in which the two coupled elements interact.

The term “directly coupled” or “coupled directly,” as used in this specification and appended claims, refers to a physical connection between identified elements, components, or objects, in which no other element, component, or object resides between those identified as being directly coupled.

The term “approximately,” as used in this specification and appended claims, refers to plus or minus 10% of the value given.

The term “about,” as used in this specification and appended claims, refers to plus or minus 20% of the value given.

The terms “generally” and “substantially,” as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Cigarette Mouthpiece

Figure 1A:
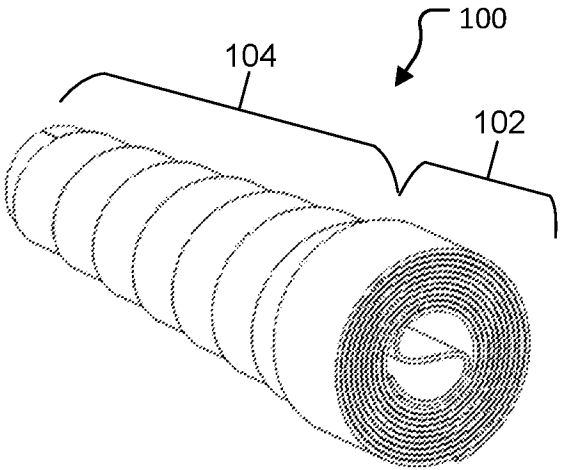
FIG. 1A is a front perspective view of a cigarette mouthpiece according to one embodiment of the present invention.

Referring to FIGS. 1A-1B, detailed diagrams of an embodiment 100 of a cigarette mouthpiece is illustrated. The cigarette mouthpiece 100 can be implemented with a variety of differently sized rolled cigarettes. Of note, an exterior diameter of the cigarette mouthpiece 100 can be adjusted to insert into an open end of a rolled cigarette and then expand to interface with and frictionally engage an interior surface of the rolled cigarette. FIG. 1A is a front perspective view of the cigarette mouthpiece 100. FIG. 1B is a back perspective view of the cigarette mouthpiece 100.

As shown, the cigarette mouthpiece 100 can include, but is not limited to, a cigarette engagement portion 102 and a user engagement portion 104. The cigarette engagement portion 102 can be configured to interface with a rolled cigarette. The user engagement portion 104 can be configured to adjust a diameter of the cigarette engagement portion 102 can interface with a user. Of note, the cigarette engagement portion 102 can generally have a larger diameter than the user engagement portion 104. Of significant note, the cigarette engagement portion 102 can include a plurality of concentric wraps to create the larger diameter. As can be appreciated, this can allow a section of the cigarette engagement portion 102 to be unwrapped and cut away to create a smaller diameter when needed.

Figure 2A:
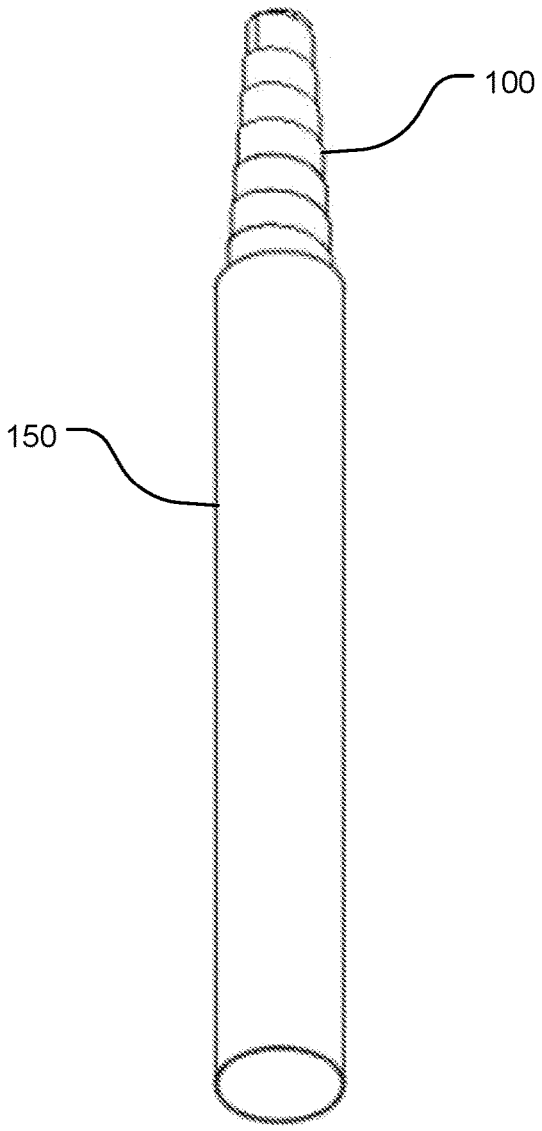
FIG. 2A is a front perspective view a cigarette mouthpiece inserted into a rolled cigarette according to one embodiment of the present invention.
Figure 2B:
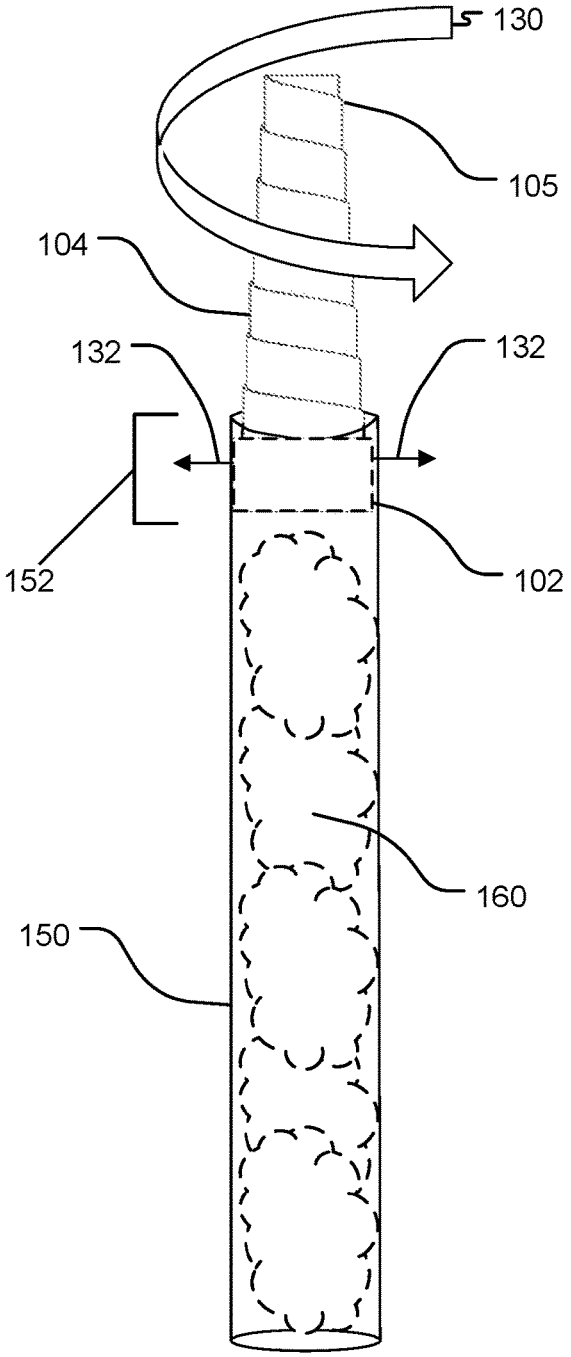
FIG. 2B is a front view a cigarette mouthpiece inserted into a rolled cigarette according to one embodiment of the present invention.

Referring to FIGS. 2A-2B, detailed diagrams of the cigarette mouthpiece 100 interfacing with a rolled cigarette 150 are illustrated. FIG. 2A is a front perspective view of the cigarette mouthpiece 100 engaged to the rolled cigarette 150. FIG. 2B is a front view of the cigarette mouthpiece 100 interfacing with the rolled cigarette 150.

The rolled cigarette 150 can be filled with tobacco 160 (or another smokable herb) and can generally include a hollow portion 152 with no tobacco 160 for receiving a mouthpiece therein. As shown, the cigarette engagement portion 102 can be inserted into the hollow portion 152 of the rolled cigarette 150. In some instances, a section of the cigarette engagement portion 102 can be cut off to reduce a diameter of the cigarette engagement portion 102. Generally, a user can remove enough material to allow the cigarette engagement portion 102 to be inserted into the rolled cigarette 150. After the cigarette mouthpiece 100 is inserted into the rolled cigarette 150, an end 105 of the user engagement portion 104 can be twisted in a direction of the spiral (e.g., shown by arrow 130) towards the cigarette engagement portion 102 causing the cigarette engagement portion 102 to expand (e.g., shown by the arrows 132). As the cigarette engagement portion 102 expands, the cigarette engagement portion 102 can apply a pressure to an interior of the rolled cigarette 150 and thereby securing the cigarette mouthpiece 100 in place. Of note, to remove the cigarette mouthpiece 100 from the rolled cigarette 150, the user engagement portion 104 can be twisted in an opposite direction and pushed in towards the cigarette engagement portion 102. This can be implemented to reduce a diameter of the cigarette engagement portion 102 and allow the cigarette mouthpiece 100 to be removed from the rolled cigarette 150.

Figure 3:
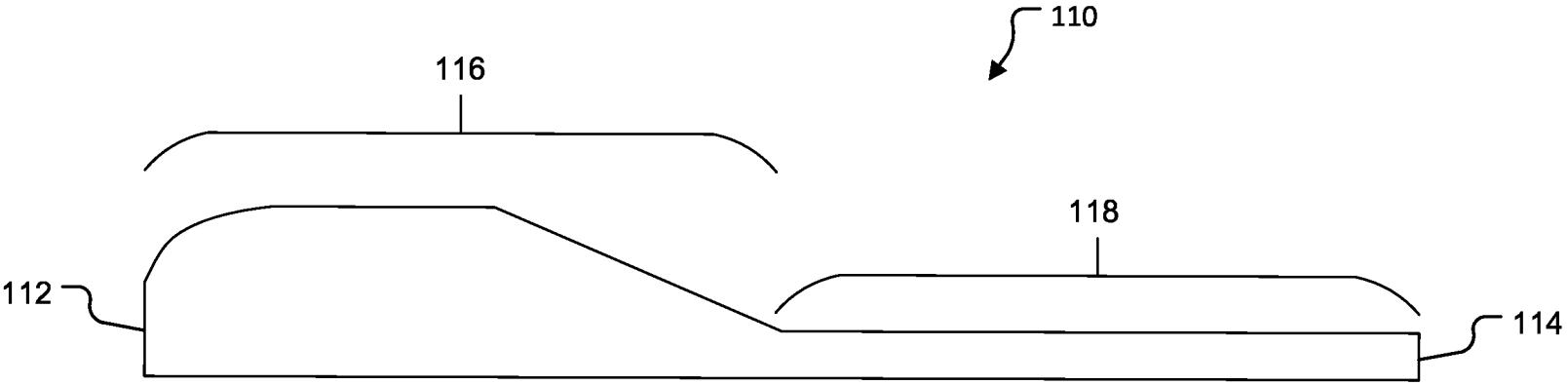
FIG. 3 is top view of a strip of flexible material according to one embodiment of the present invention.
Figure 4A:
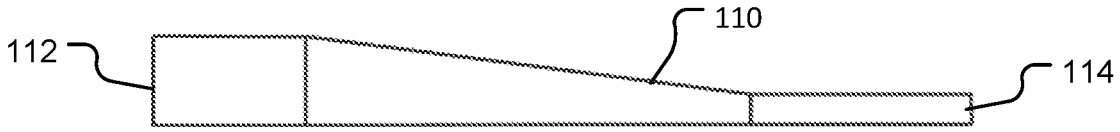
FIG. 4A is top view of a strip of flexible material according to one embodiment of the present invention.
Figure 4B:
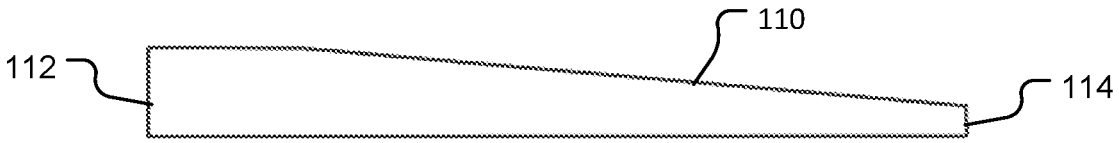
FIG. 4B is top view of a strip of flexible material according to one embodiment of the present invention.
Figure 4C:
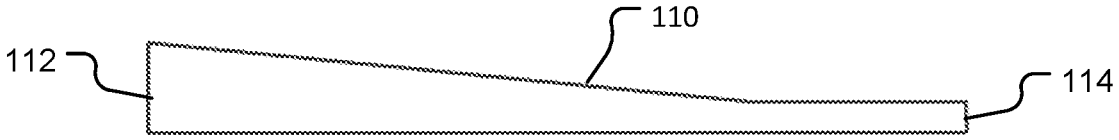
FIG. 4C is top view of a strip of flexible material according to one embodiment of the present invention.
Figure 4D:
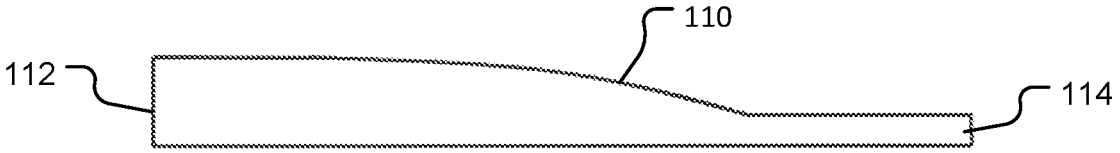
FIG. 4D is top view of a strip of flexible material according to one embodiment of the present invention.
Figure 4E:
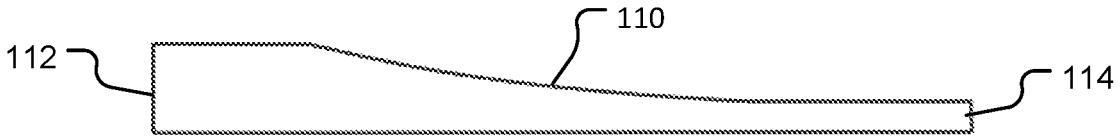
FIG. 4E is top view of a strip of flexible material according to one embodiment of the present invention.
Figure 4F:
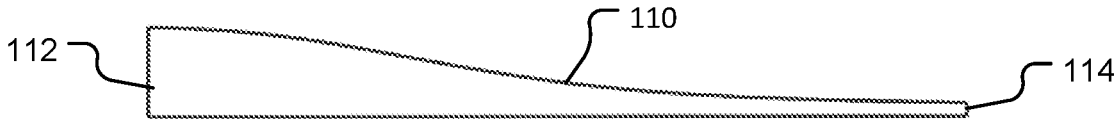
FIG. 4F is top view of a strip of flexible material according to one embodiment of the present invention.

Referring to FIG. 3, a detailed diagram of a preferred embodiment of a flexible sheet of material 110 that may be implemented to create the cigarette mouthpiece 100 is illustrated. Of note, the preferred embodiment shown in FIG. 3 is one example embodiment and is not meant to be limiting. Typically, the flexible sheet of material 110 can be an elongated sheet of flexible material having a varying width from a first end to a second end.

As shown in FIG. 3, the flexible sheet of material 110 can be defined by a first end 112 having a first width, a second end 114 having a second width, and a length of the flexible sheet of material defined from the first end 112 to the second end 114. A bottom edge of the flexible sheet of material 110 can generally be straight while a top edge of the flexible sheet of material 110 can taper up and/or down. Generally, the flexible sheet of material 110 can include a first section 116 for forming the user engagement portion 104 and a second section 118 for forming the cigarette engagement portion 102. The first section of 116 of the flexible sheet of material 110 can have generally have a larger width than the second section 118 of the flexible sheet of material 110.

As shown, the first section 116 can start at the first end 112 and extend about half a length of the flexible sheet of material 110. The second section 118 can start at about a midpoint of the flexible sheet of material 110 and extend to the second end 114. The first section 116 can start at the first width, taper up to a third width wider than the first width and then taper down to the second width of the second end 114. As previously mentioned, a width of the first section 116 can typically determine a length of the user engagement portion 104 and a width of the second section 118 can typically determine a length of the cigarette engagement portion 102.

Referring to FIGS. 4A-4F, various different example embodiments of the flexible sheet of material 110 are illustrated. Of note, although several differently shaped strips of material are shown, the different embodiments are not meant to be limiting. In general, the flexible sheet of material 110 can have a wider width on a first end tapering to a smaller width at a second end. When making the cigarette mouthpiece 100, rolling of the flexible sheet of material 110 can begin with the wider end. When rolling the cigarette mouthpiece 100, the first section 116 of the flexible sheet of material 110 can generally be rolled in a spiral and then the second section 118 of the flexible sheet of material 110 can be rolled concentrically on top of itself. Of note, this can allow for the user engagement portion 104 to be more easily elongated and shortened when adjusting the cigarette engagement portion 102. Of significant note, this can allow for an exterior diameter of the cigarette engagement portion 102 to be adjusted without affecting an overall length of the cigarette engagement portion 102. As can be appreciated, this allows the cigarette engagement portion 102 to expand and contract with minimal to no change in the length of the cigarette engagement portion 102 providing a constant contact area with an interior of a rolled cigarette.

Figure 5A:
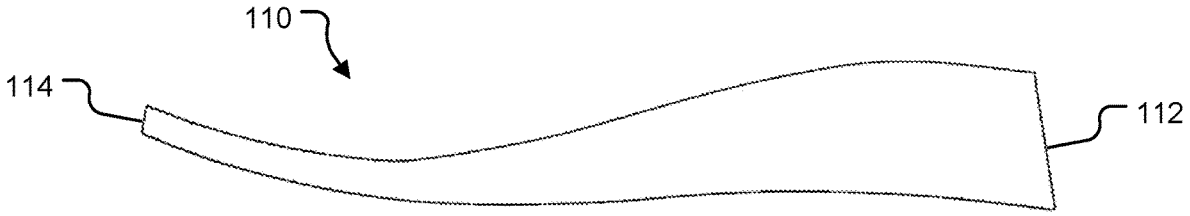
FIG. 5A is a top perspective view of a strip of flexible material being rolled according to one embodiment of the present invention.
Figure 5B:
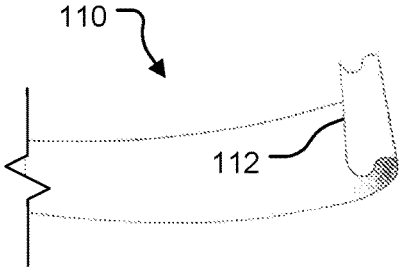
FIG. 5B is a top perspective view of a strip of flexible material being rolled according to one embodiment of the present invention.
Figure 5C:
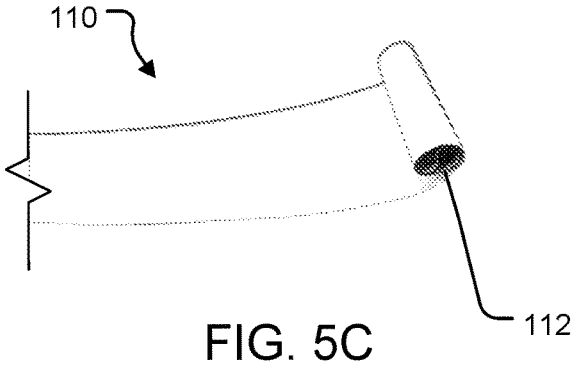
FIG. 5C is a top perspective view of a strip of flexible material being rolled according to one embodiment of the present invention.

Referring to FIGS. 5A-5C, one example method of creating the cigarette mouthpiece 100 from a flexible sheet of material 110 is illustrated. As shown, the strip of flexible material 110 can be rolled starting at the first end 112 (having a greater width than the second end 114) and rolling on itself towards the second end 114. In one instance, two loops that fold over themselves to create a substantially "S-curve" can be folded first before the first end 112 is rolled towards the second end 114. The strip of flexible material 110 can then be rolled while maintaining the substantially S-curve in a center of the rolled flexible material. The strip of flexible material 110 can then be rolled entirely to the second end 114. In one instance, the rolled strip of flexible material 110 can be defined by a geometry closely resembling a truncated cone. After the strip of flexible material 110 has been completely rolled, a loose end (the second end 114) of the rolled strip of flexible material 110 can be adhered (e.g., glued or taped) or physically secured in place (e.g., via a strap) to itself to prevent the strip of flexible material 110 from unrolling until the cigarette mouthpiece may be ready to be used. Of note, since the second section 118 has a uniform width, when the second section 118 of the strip of flexible material 110 is rolled upon itself, the second section 118 may roll concentrically upon itself. As can be appreciated, once the strip of flexible material 110 is completely rolled, a diameter of the cigarette engagement portion 102 can be greater than a diameter of the user engagement portion 104. Further, a width of the second section 118 of the strip of flexible material 110 can determine a length of the cigarette engagement portion 102.

An Embodiment of a Cigarette Mouthpiece Kit

Figure 6A:
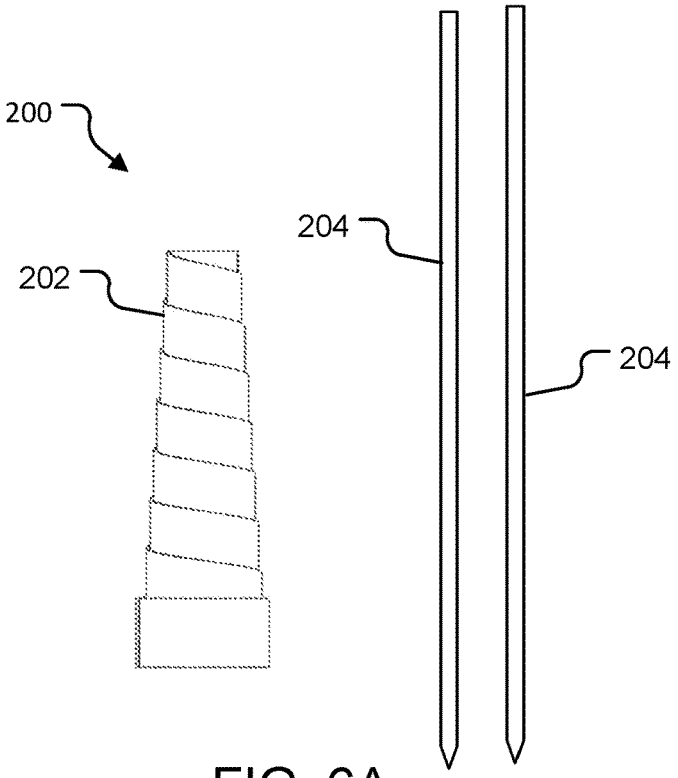
FIG. 6A is a front view of a cigarette mouthpiece kit according to one embodiment of the present invention.
Figure 6B:
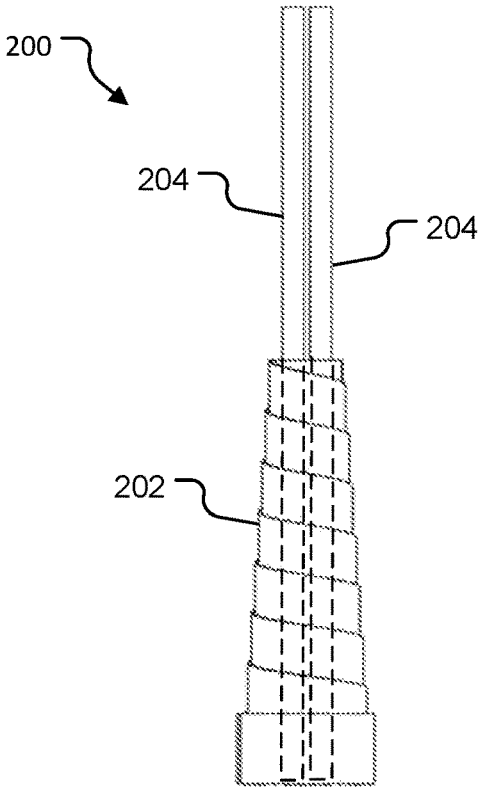
FIG. 6B is a front view of a cigarette mouthpiece kit according to one embodiment of the present invention.
Figure 6C:
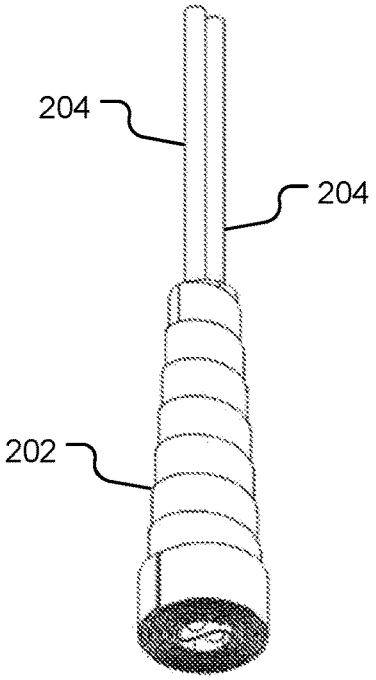
FIG. 6C is a front perspective view of a cigarette mouthpiece kit according to one embodiment of the present invention.
Figure 6D:
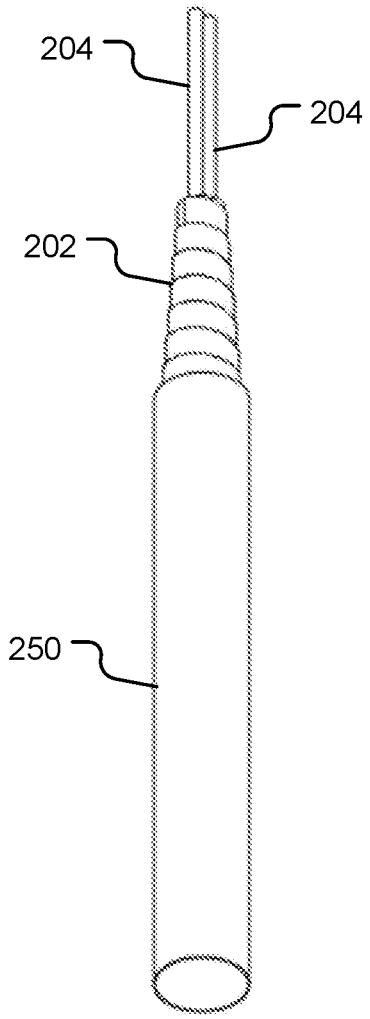
FIG. 6D is a front perspective view of a cigarette mouthpiece kit interfacing with a rolled cigarette according to one embodiment of the present invention.

Referring to FIGS. 6A-6D, detailed diagrams of an embodiment 200 of a cigarette mouthpiece kit is illustrated. FIG. 6A is a front view of components of the cigarette mouthpiece kit 200. FIG. 6B is a front view of the components of the cigarette mouthpiece kit 200 interacting with one another. FIG. 6C is a front perspective view of the components of the cigarette mouthpiece kit 200 interacting with one another. FIG. 6D is a front perspective view of the cigarette mouthpiece kit 200 interfacing with a hand rolled cigarette.

As shown generally, the cigarette mouthpiece kit 200 can include, but is not limited to, a cigarette mouthpiece 200 and a pair of rods 204. The cigarette mouthpiece 200 can be substantially similar to the previously described cigarette mouthpiece 100. The pair of rods 204 can be provided in the kit 200 to help tighten and loosen the cigarette mouthpiece 202 when inserted into a rolled cigarette. The pair of rods 204 can each be sized to fit into the cigarette mouthpiece 202, as shown in FIGS. 6B-6C. The pair of rods 204 can be manufactured from a rigid material. For instance, the pair of rods 204 can be made from steel. In another example, the pair of rods 204 can be made from a rigid plastic. In yet another example, the pair of rods 204 can be made from wood.

In one example implementation of the cigarette mouthpiece 202 with the pair of rods 204, the pair of rods 204 can first be inserted into a user engagement portion of the cigarette mouthpiece 202. Next, a cigarette engagement portion of the cigarette mouthpiece 202 can be sized to be inserted into a hollow portion of a rolled cigarette 250, as shown in FIG. 6D. To decrease a diameter of the cigarette engagement portion, the pair of rods 204 can be rotated in a first direction. To increase the diameter of the cigarette engagement portion, the pair of rods 204 can be rotated in a second direction opposite to the first direction. After the cigarette engagement portion has been inserted into the rolled cigarette 250, the pair of rods 204 can be rotated in the second direction to increase the diameter of the cigarette engagement portion inside the rolled cigarette 250. On the cigarette mouthpiece 202 is secured in place, the pair of rods 204 can be removed and a user can enjoy the rolled cigarette 250.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A cigarette mouthpiece comprising:
- a main body rolled from an elongated strip of flexible material, the main body defined by:
  - a cigarette engagement portion having a first length, the first length determined by a width of a first section of the elongated strip; and
  - a user engagement portion having a second length, the second length determined by a width of a second section of the elongated strip;
- wherein an exterior diameter of the cigarette engagement portion is reduced while an exterior diameter of the user engagement portion remains unchanged.

2. The cigarette mouthpiece of claim 1, wherein the elongated strip is defined by:
- the first section having a first width and a first length; and
- the second section having a second width and a second length, the second width being greater than the first width and the second length of the elongated strip approximately equal to the first length of the elongated strip.

3. The cigarette mouthpiece of claim 2, wherein the main body is formed by the second section of the elongated strip being rolled on itself towards the first section.

4. The cigarette mouthpiece of claim 1, wherein an exterior diameter of the cigarette engagement portion is greater than an exterior diameter of the user engagement portion.

5. The cigarette mouthpiece of claim 1, wherein an exterior diameter of the cigarette engagement portion is alterable.

6. The cigarette mouthpiece of claim 5, wherein an exterior diameter of the user engagement portion is alterable.

7. The cigarette mouthpiece of claim 1, wherein the elongated strip is defined by:
- a first end having a first width;
- a second end having a second width, the first width being greater than the second width;
- a bottom edge being substantially straight; and
- a top edge tapering up from the first end to a third width and then tapering down to the second width.

8. The cigarette mouthpiece of claim 7, wherein the width of the first section is equal to the second width.

9. The cigarette mouthpiece of claim 7, wherein the main body is formed by the elongated strip being rolled on itself from the first end to the second end.

10. A cigarette mouthpiece comprising:
- a main body rolled from an elongated strip of flexible material, the elongated strip of flexible material defined by:
  - a first end having a first width;
  - a second end having a second width, the first width being greater than the second width;
  - a bottom edge being substantially straight; and
  - a top edge at least tapering down from the first width to the second width;
  - a user engagement portion being formed by a first section of the elongated strip of flexible material; and
  - a cigarette engagement portion being formed by a second section of the elongated strip of flexible material;
- wherein an exterior diameter of the cigarette engagement portion is reduced while an exterior diameter of the user engagement portion remains substantially unchanged.

11. The cigarette mouthpiece of claim 10, wherein (i) the first section includes the elongated strip of material between the first end and a midpoint of the elongated strip of material; and (ii) the second section includes the elongated strip of material between the midpoint and the second end of the elongated strip of material.

12. The cigarette mouthpiece of claim 10, wherein the second end is adhered to the elongated strip of flexible material.

13. The cigarette mouthpiece of claim 10, wherein the top edge tapers up to a third width and then tapers down to the second width.

14. A cigarette mouthpiece kit comprising:
- a pair of rods; and
- a cigarette mouthpiece, the cigarette mouthpiece being rolled from an elongated strip of flexible material, the elongated strip of flexible material defined by:
  - a first end having a first width;
  - a second end having a second width, the first width being greater than the second width;
  - a bottom edge being substantially straight; and
  - a top edge at least tapering down from the first width to the second width.

15. The cigarette mouthpiece kit of claim 14, wherein the cigarette mouthpiece includes a cigarette engagement portion and a user engagement portion.

16. The cigarette mouthpiece kit of claim 15, wherein the two rods are sized to fit into the user engagement portion of the cigarette mouthpiece.

17. The cigarette mouthpiece kit of claim 16, wherein when the two rods are inserted into the user engagement portion and rotated a first direction, an exterior diameter of the cigarette engagement portion is reduced.

18. The cigarette mouthpiece kit of claim 17, wherein when the two rods are inserted into the user engagement portion and rotated a second direction opposite to the first direction, the exterior diameter of the cigarette engagement portion is increased.

* * * * *